United States Patent [19]

Uedaira et al.

[11] 4,212,344

[45] Jul. 15, 1980

[54] METHOD OF MANUFACTURING AN AMORPHOUS ALLOY

[75] Inventors: Satoru Uedaira; Shigeyasu Ito, both of Yokohama, Japan

[73] Assignee: Sony Corporation, Tokyo, Japan

[21] Appl. No.: 936,102

[22] Filed: Aug. 23, 1978

[30] Foreign Application Priority Data

Sep. 12, 1977 [JP] Japan ..... 52/109747

[51] Int. Cl.[2] ..... B22D 11/06; B22D 11/16

[52] U.S. Cl. ..... 164/87; 164/423; 164/428

[58] Field of Search ..... 164/87, 82, 423, 428; 264/165, 176 F

[56] References Cited

U.S. PATENT DOCUMENTS

| | | | |
|---|---|---|---|
| 3,862,658 | 1/1975 | Bedell | 164/423 X |
| 3,863,700 | 2/1975 | Bedell et al. | 164/423 X |
| 3,881,541 | 5/1975 | Bedell | 164/423 X |
| 3,960,200 | 6/1976 | Kavesa | 164/423 |

OTHER PUBLICATIONS

Chen et al., "A Rapid Quenching Technique for the Preparation of Thin Uniform Films of Amorphous Solids", *Rev. Sci. Instrum.,* vol. 41, pp. 1237–1238, 8/1970.

*Primary Examiner*—Robert D. Baldwin
*Assistant Examiner*—Gus T. Hampilos
*Attorney, Agent, or Firm*—Hill, Van Santen, Steadman, Chiara & Simpson

[57] ABSTRACT

A method of manufacturing an amorphous alloy in which a molten mixture of raw materials making up the amorphous alloy is first prepared, and then introduced between a pair of oppositely rotating rolls where the molten material is rolled and quenched into a film. The conditions under which the rolling and quenching occur are carried out under the following conditions:

$$Y \geqq C_o\left(\frac{A}{2850}\right)^2\left(\frac{R}{15}\right)\left(\frac{X}{T_{cry}-T}\right)^4$$

where:

Y is the roll pressure per unit width of the film in metric tons per centimeter, $C_o$ is a constant determined by Young's modulus and the thermal conductivity of the material of the rolls, A is the rotational speed of the rolls in r.p.m., R is the diameter of the rolls in centimeters, X is the thickness of the film in microns, $T_{cry}$ is the crystallization temperature of the amorphous alloy in °C., T is the temperature of the rolls in °C., and where $$\frac{1}{R} = \frac{1}{2}\left(\frac{1}{R_1} + \frac{1}{R_2}\right)$$

where the rolls have the diameters of $R_1$ and $R_2$ centimeters, respectively.

11 Claims, 14 Drawing Figures

Fe78Si10B12
Fe72Cr8P13C7
Amorphous region
h
(Thickness of sample 50μm)
Nonamorphous region
g
(Thickness of sample 40μm)
Fe80P13C7
Amorphous region
Nonamorphous region
Roll pressure per unit width of sample (ton/cm)
5
2
1
0.5
0.2
0.1
1
2
3
4
5
(1/ΔT)⁴×10¹¹

$Fe_{80}P_{13}C_7$
Rotational speed of roll 2850r.p.m.
Thickness of sample 50 μm
Roll pressure per unit width of sample (ton/cm)
10
8
6
4
2
0
0
5
10
15
20
Roll diameter (cm)
Amorphous region
Nonamorphous region
m $Fe_{80}P_{13}C_7$
Rotational speed of roll 2850r.p.m.
Thickness of sample 60μm
Amorphous region
Nonamorphous region
n
Roll pressure per unit width of sample (ton/cm)
Roll diameter (cm)
0
2
4
6
8
10
0
5
10
15
20

METHOD OF MANUFACTURING AN AMORPHOUS ALLOY

BACKGROUND OF THE INVENTION

1. Field of the Invention

This invention is in the field of manufacturing an amorphous alloy and, more particularly, to a method of manufacturing an amorphous alloy film containing iron, cobalt, or nickel as its predominating ingredient by means of a pair of quenching rolls.

2. Description of the Prior Art

Recently, amorphous alloys have been prepared having interesting thermal, electrical, magnetic and mechanical properties. Amorphous alloys have, in general, several advantages. For one, their mechanical strength is greater than the crystalline metal materials. The modulus of rigidity is lower than that of crystalline metals by a factor of 20 to 40%. The amorphous alloys do not exhibit work hardening and their electrical resistance is generally high. The corrosion resistance of amorphous alloys can be substantially improved by the addition of chromium and the like. Finally, such alloys have been found to have high permeability.

There have been attempts made to utilize such amorphous alloys for audio recording heads, video heads, various types of transformers, delay lines and the like. There has also been some suggestion of using amorphous alloys as tensile materials and as anti-corrosive materials.

In general there are three known methods of manufacturing amorphous alloys. These are the centrifugal quenching method, the splat cooling method used with a plasma furnace, and a roll quenching method. The roll quenching method is generally inferior in cooling speed to the centrifugal quenching method and the splat cooling method. Some types of amorphous alloys cannot be manufactured by the roll quenching method, although they can be manufactured by the other methods. In the roll quenching method, an oxidation film is often formed on the surface of the amorphous alloy to provide the same with a color, and a strong amorphous alloy is hard to obtain since the cooling speed is low.

To overcome these disadvantages, it was suggested that a water bath be positioned directly under a pair of quenching rolls, and to introduce the film extruded from the rolls into the water bath. In this case, it is necessary to arrange the rolls close to the water surface of the water bath in order to introduce the film into the water bath as soon as possible. The rolls are unavoidably splashed with water when the film is led into the water bath. As a result, the width and thickness of the film are not uniform which is undesirable. On the other hand, when the rolls are moved farther from the water bath, the cooling effect is reduced and a so-called "waving" phenomenon occurs in the film extruded from the rolls. In this instance, a straight long film cannot be obtained.

To overcome these disadvantages, the assignee of the present application has suggested a novel roll quenching apparatus in Japanese Patent Application No. 22937/1977. The apparatus described comprises a pair of quenching rolls which are, for example, made of steel and are rotated in opposite directions at the same speed with the same diameter. These rolls are used in conjunction with a rotary member such as a rotary drum made of copper which is arranged adjacent to at least one of the rolls. A film or strip rolled from the rolls is guided onto the rotary member in contact with a portion of the circumferential surface of the rotary member so that it is further cooled. With the use of this type of apparatus, a strong and straight amorphous alloy film can be consistently manufactured, with little danger of oxidation.

The assignee of this application has also proposed a further novel roll quenching apparatus in Japanese Patent Application No. 22936/1977. In this application, there is described an apparatus which includes a pair of quenching rolls made, for example, of steel which are rotated at different speeds. With the use of this apparatus, a strong amorphous alloy film can be manufactured readily, with little danger of oxidation.

The apparatus described in the aforementioned Japanese applications operates very effectively, but still provides room for improvement.

SUMMARY OF THE INVENTION

The present invention provides a means of controlling the parameters in the operation of roll quenching apparatus so as to provide uniformly an alloy film of predetermined width and thickness. Essentially, the invention involves controlling the roll pressure of the quenching rolls in relationship to the rotational speed of the rolls, the diameter of the rolls, the thickness of the film, and the temperatures involved.

In accordance with the present invention, we prepare a molten mixture of raw materials in predetermined amounts to form the desired amorphous alloy. The molten mixture is then passed into the nip between a pair of oppositely rotating rolls to thereby form a film of the amorphous alloy. The rolling and quenching are carried out so as to satisfy the following conditions:

$$Y \geqq C_o\left(\frac{A}{2850}\right)^2\left(\frac{R}{15}\right)\left(\frac{X}{T_{cry}-T}\right)^4$$

where:

Y is the roll pressure per unit width of the film in metric tons per centimeter, $C_o$ is a constant determined by Young's modulus and the thermal conductivity of the material of the rolls, A is the rotational speed of the rolls in r.p.m., R is the diameter of the rolls in centimeters, X is the thickness of the film in microns, $T_{cry}$ is the crystallization temperature of the amorphous alloy in °C., T is the temperature of the rolls in °C., and where $$\frac{1}{R} = \frac{1}{2}\left(\frac{1}{R_1} + \frac{1}{R_2}\right)$$

where the rolls have the diameters of $R_1$ and $R_2$ centimeters, respectively.

Various advantages and features of the present invention will become readily apparent from the ensuing detailed description, and the novel features will be particularly pointed out in the appended claims.

DESCRIPTION OF THE PREFERRED EMBODIMENTS

Figure 1:
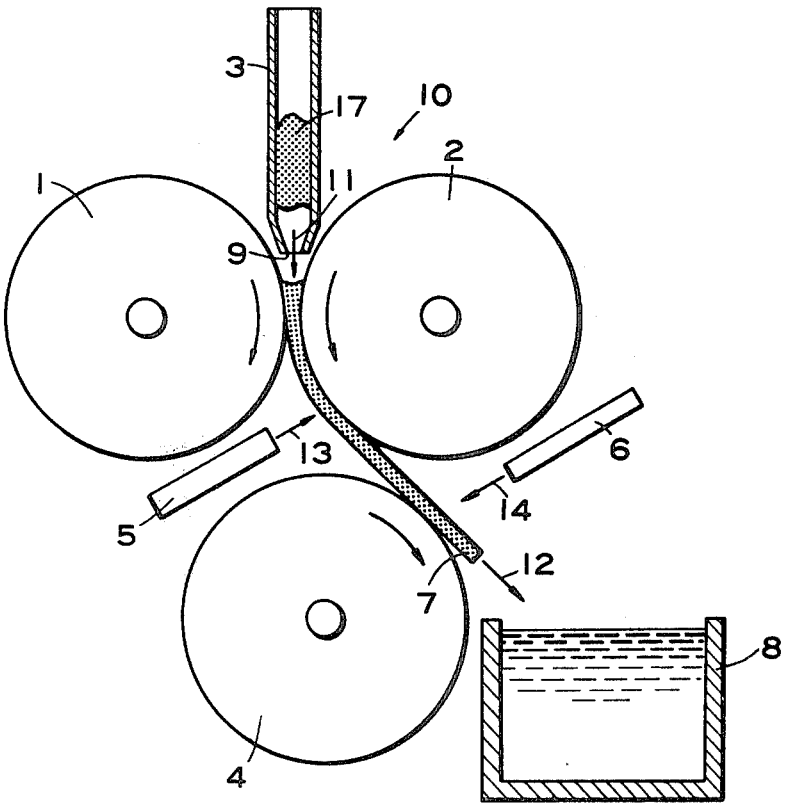
FIG. 1 is a schematic view of a roll quenching apparatus according to one embodiment of the present invention.

FIG. 1 is a schematic view of a roll quenching apparatus indicated generally at reference numeral 10. The apparatus comprises a pair of rolls 1 and 2 made of hard chromium steel which rotate, for example, at a speed of 2800 r.p.m. in opposite directions. A heat resistive nozzle body 3 is arranged to inject a molten mixture into the nip between the rolls 1 and 2. A rotary drum 4 made of highly heat-conductive material such as copper is positioned below the gap between the rolls 1 and 2 and adjacent to one of the rolls. An air ejecting nozzle body 5 is positioned between the roll 1 and the rotary drum 4. Another air ejecting nozzle body 6 is arranged adjacent to the roll 2. A water bath 8 is provided for further cooling a quenched film or strip 7 formed between the rolls 1 and 2. A drive means (not shown) is provided for rotating the rolls 1 and 2 and the rotary drum 4. Since the rotary drum 4 is made of highly heat-conductive material such as copper, it effectively dissipates heat from the film 7 extruded from the rolls 1 and 2. As clear from the following description, it is preferred that the peripheral speed of the rotary drum 4 be higher than that of the rolls 1 and 2. For example, the rotational speed of the rotary drum may be about 9000 r.p.m. Since the film 7 is discharged at a high speed from the gap between the rolls 1 and 2, it is preferable from the viewpoint of stable film running that the path of the film 7 from the gap onto the rotary drum 4 be as short as possible.

A sample having the correct molecular proportions of the ingredients is crushed and the crushed sample is put into the nozzle body 3. The nozzle body containing the sample is put into a furnace made of silicon carbide, and the sample is melted in the nozzle body 3. Then this nozzle body 3 is moved down directly above the gap between the rolls 1 and 2 from the furnace. A high pressure gas such as argon is blown into the nozzle body 3 to discharge the molten sample 17 into the gap between the rolls 1 and 2 through a nozzle opening 9 in a direction shown by the arrow 11. The molten sample 17 is rolled and quenched by the rolls 1 and 2. The rolled sample, consisting of a filmy strip 7 is extruded from the gap between the rolls 1 and 2 and directly guided onto the rotary drum 4 located adjacent to the roll 2. The film 7 in contact with the rotary drum 4 is guided in the direction of rotation of the rotary drum 4 as shown by the arrow 12 in FIG. 1. During this time, the film 7 is further cooled by contact with the rotary drum 4. The path of the film 7 is such that directly after the film 7 is extruded from the gap between the rolls 1 and 2, it is guided onto the rotary drum 4 while contacting roll 2. In comparison with the conventional method of roll cooling, the time that the film contacts the roll 2 is considerably long and the cooling efficiency is improved.

Air for further cooling the film 7 and guiding the film is blown onto the film from the nozzle body 5 in the direction shown by the arrow 13. Additional air for further cooling the film is blown thereon while the film contacts the rotary drum 4 by means of the nozzle body 6. Accordingly, the cooling efficiency of the film is still further improved. The film cooled and guided by the rotary drum 4 is then directed into the water bath 8 and further cooled therein.

As described above, the film 7 is extruded from the rolls 1 and 2 in the same manner as the conventional method. However, in accordance with the present invention, the film 7 is further guided onto the rotary drum 4 directly after being extruded from the rolls 1 and 2 where it is further cooled. Because the cooling speed is improved, an amorphous alloy can be more reliably manufactured. Even amorphous alloys which cannot be manufactured by the conventional method, can be manufactured according to this embodiment. The cooling speed of the film 7 is further improved by virtue of the air which is blown onto the the film from the nozzle bodies 5 and 6 and then the film is introduced into the water bath 8 while being guided in contact with the rotary drum 4. Since the peripheral speed of the rotary drum 4 is higher than that of the rolls 1 and 2, the film can be satisfactorily guided and cooled. The gap between the roll 2 and the rotary drum 4 should be sufficiently large to avoid pressing the film onto the rotary drum 4, since the copper rotary drum is apt to be damaged.

Since the cooling speed of the film is high, it is satisfactorily cooled in a short time so that surface oxidation of the film 7 is reduced to a minimum. Consequently, a strong amorphous alloy is obtained.

In the illustrated form of the invention, directly after the film 7 is extruded from the gap between the rolls 1 and 2, it is guided by the rotary drum 4. Accordingly, the waving of the film 7 can be avoided, and a long straight film of amorphous alloy can be consistently manufactured.

When the drive means for the roll 2 is disconnected after the rolls 1 and 2 are driven, the peripheral speeds of the rolls 1 and 2 become different from each other so that the film 7 is made to contact closer with the roll 2 to further improve the cooling speed. Although it is preferable that the rotary drum 4 and the water bath 8 be included in the roll quenching apparatus, one or both may be omitted as deemed necessary.

Utilizing the above type of roll quenching apparatus, the present inventors have investigated the conditions required to uniformly obtain an amorphous alloy composed mainly of iron, cobalt or nickel. It has been proved that the roll pressure should be higher than the predetermined pressure in order to obtain an amorphous film of predetermined width and thickness.

RELATIONSHIP BETWEEN THICKNESS OF FILM AND ROLL PRESSURE

Figure 2:
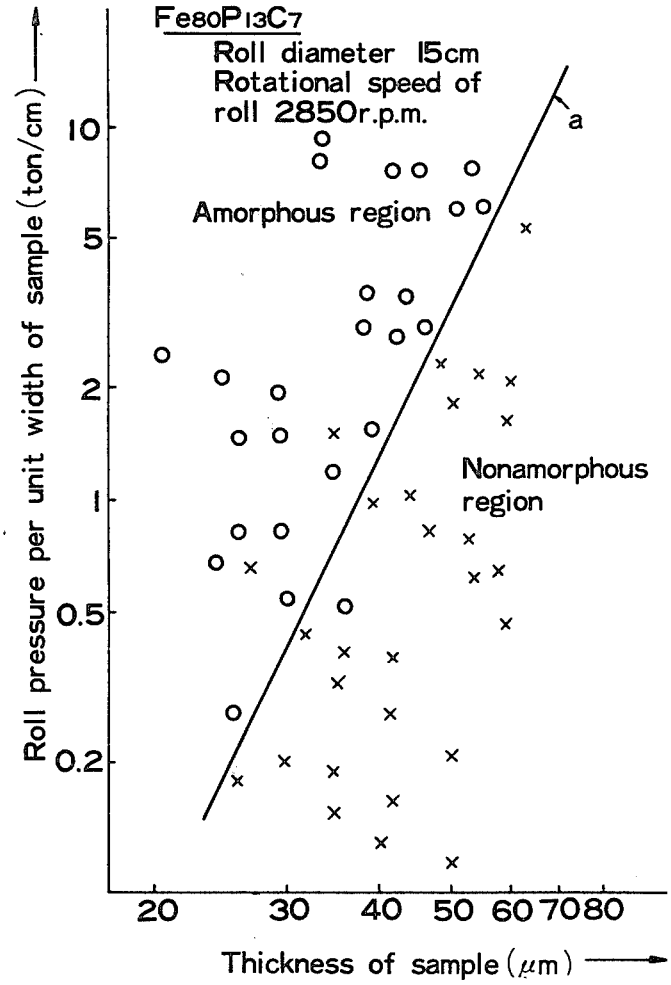
FIGS. 2 to 7 are graphs showing the relationship between the roll pressure and the thickness of the sample, the ordinates being on a logarithmic scale.

Rolls 1 and 2 composed of iron having diameters of 15 cm and rotational speeds of 2850 r.p.m. respectively were used for obtaining a film of amorphous alloy having the empirical formula $Fe_{80}P_{13}C_7$. The relationship between the roll pressure and the thickness of the sample was determined and the results are shown in FIG. 2. In this Figure, it will be understood that the amorphous region is that located above the line a. In FIG. 2, the circles represent amorphous alloys being obtained, and the "x" marks mean that amorphous alloys were not obtained, which designation is used in succeeding figures. From the graph of FIG. 2, it will be seen that the amorphous alloy can be manufactured only under a considerably high roll pressure in contrast to the lower pressures conventionally used.

Figure 3:
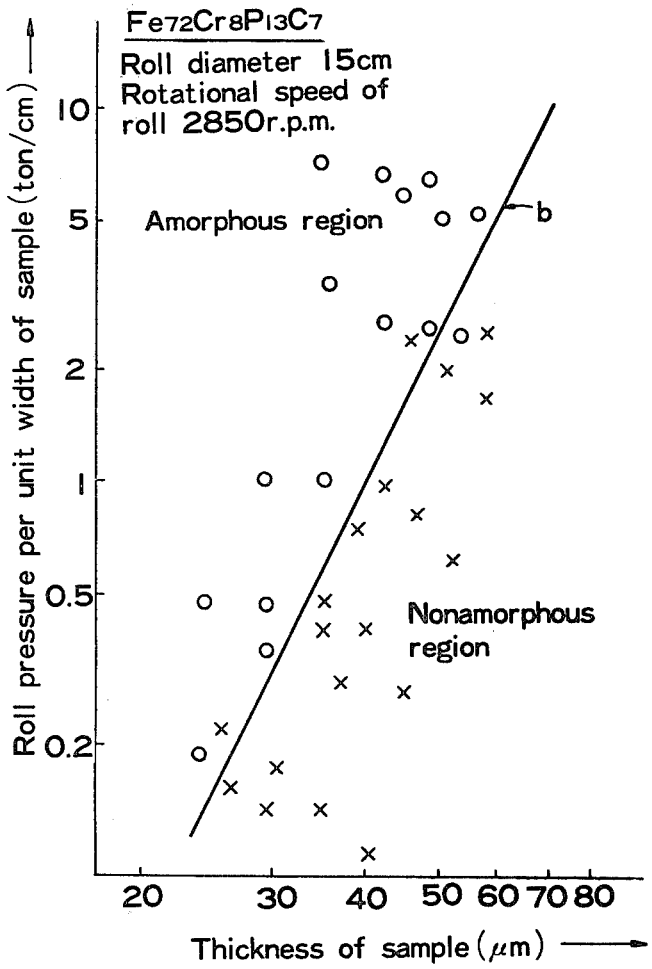

The same conditions as in the case of FIG. 2 were used to obtain a film of amorphous alloy of $Fe_{72}Cr_8P_{13}C_7$. The relationship between the roll pressure and the thickness of the sample was determined. The results are shown in FIG. 3 from which it will be understood that the region above the line b should be used in obtaining the amorphous alloy.

Figure 4:
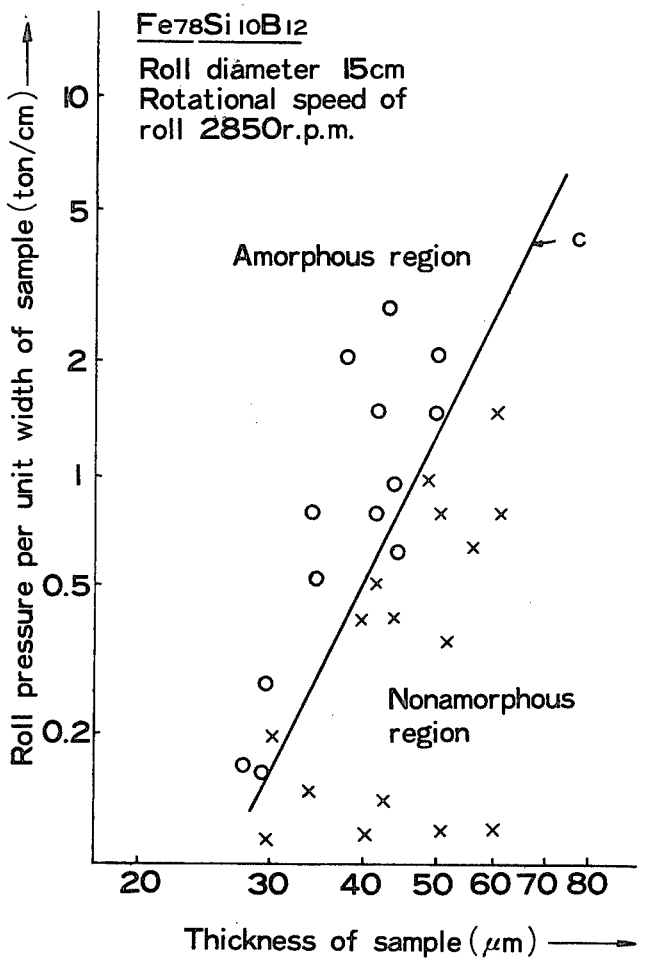

The same conditions as were used in FIG. 2 were used to obtain a film of amorphous alloy of $Fe_{78}Si_{10}B_{12}$. The relationship between the roll pressure and the thickness of the sample was determined and the results are plotted in FIG. 4. It will be understood from FIG. 4 that the portion of the curve above the line c should be used for obtaining an amorphous alloy.

Figure 5:
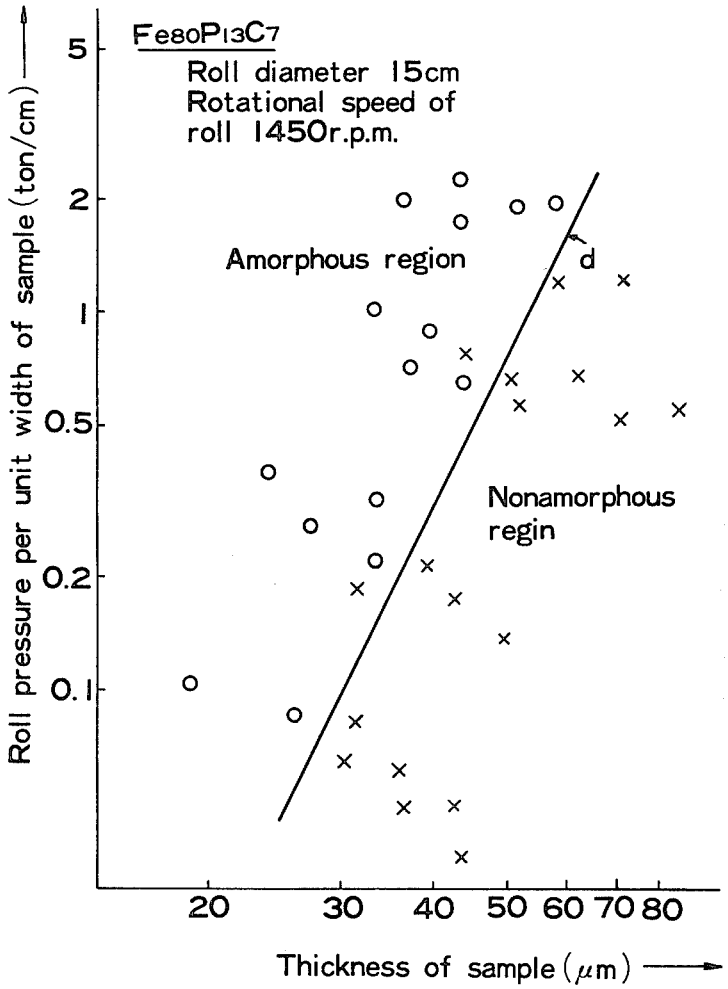

An amorphous alloy of $Fe_{80}P_{13}C_7$ was obtained by reducing the rotational speed of the rolls 1 and 2 to 1450 r.p.m. The same rolls were used as in the previous cases. The results are shown in FIG. 5. It will be seen from FIG. 5 that the region of the graph above the line d should be selected for obtaining an amorphous alloy with respect to roll pressure per unit width of the sample and thickness of the sample.

Figure 6:
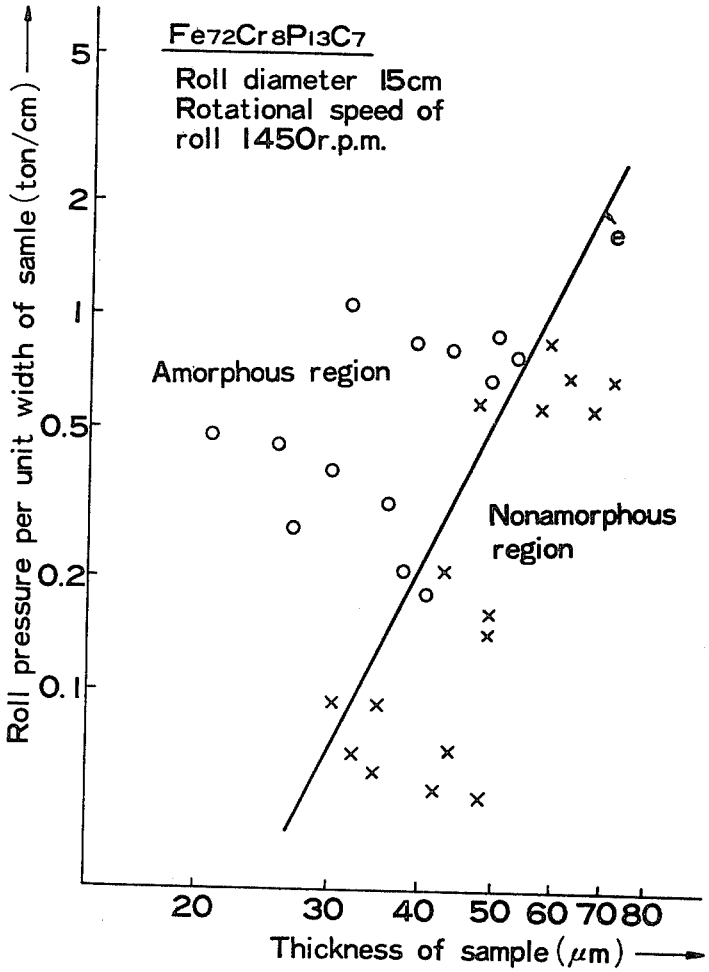

An amorphous alloy having the composition $Fe_{72}Cr_8P_{13}C_7$ was made under the same conditions as in FIG. 5, with the results being shown in FIG. 6. It will be understood that the region of amorphous alloy production extends above the line e.

Figure 7:
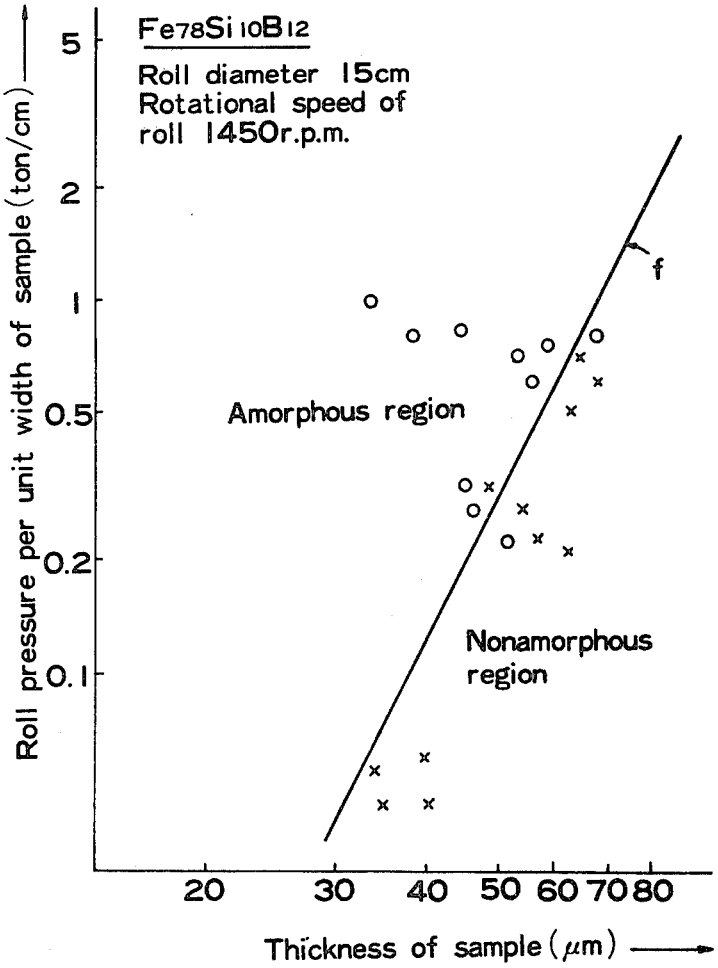

An amorphous alloy having the composition $Fe_{78}Si_{10}B_{12}$ was made under the same conditions as those in FIG. 5. The results are shown in FIG. 7 from which it will be understood that the region of amorphous alloy production extends above the line f.

From the results shown in FIGS. 2 to 7, inclusive, it can be determined how high a roll pressure is required for obtaining an amorphous alloy film of given thickness and width. With the thickness of the film represented by X in microns, it will be seen that the roll pressure Y on the lines a to f is approximately proportional to $X^4$. Therefore, the following requirements should be fulfilled for obtaining an amorphous alloy:

$Y \geqq R_1X^4$ where $R_1$ is a constant.

RELATIONSHIP BETWEEN CRYSTALLIZATION TEMPERATURE AND ROLL PRESSURE

From FIGS. 2 to 7, it will be understood that the roll pressure for obtaining an amorphous alloy depends on the crystallization temperature thereof. The crystallization temperature $T_{cry}$ is obtained by the exothermic change on heating, by the well known differential thermal analysis method.

The crystallization temperatures $T_{cry}$ of various amorphous alloys which have been produced are shown in Table 1.

Table 1

| Composition of amorphous alloy | $T_{cry}$ (°C.) | Composition of amorphous alloy | $T_{cry}$ (°C.) |
|---|---|---|---|
| $Fe_{80}P_{13}C_7$ | 410 | $Fe_{76.3}Si_{5.7}B_{18}$ | 523 |
| $Fe_{78}Cr_2P_{13}C_7$ | 419 | $Fe_{78.1}Si_{5.9}B_{16}$ | 507 |
| $Fe_{76}Cr_4P_{13}C_7$ | 429 | $Fe_{76.1}Cr_2Si_{5.9}B_{16}$ | 512 |
| $Fe_{74}Cr_6P_{13}C_7$ | 430 | $Fe_{74.1}Cr_4Si_{5.9}B_{16}$ | 514 |
| $Fe_{72}Cr_8P_{13}C_7$ | 437 | $Fe_{76.1}Al_2Si_{5.9}B_{16}$ | 520 |
| $Fe_{80}Cr_2P_{11.7}C_{6.3}$ | 396 | $Fe_{78}Si_{10}B_{12}$ | 500 |

Table 1-continued

| Composition of amorphous alloy | $T_{cry}$ (°C.) | Composition of amorphous alloy | $T_{cry}$ (°C.) |
|---|---|---|---|
| $Fe_{79}Ru_1P_{13}C_7$ | 429 | $Fe_{76}Cr_2Si_{10}B_{12}$ | 522 |
| $Fe_{78}Ru_2P_{13}C_7$ | 431 | $Fe_{76}V_4P_{13}C_7$ | 411 |
| $Fe_{76}Ru_4P_{13}C_7$ | 420 | | |

Figure 8:
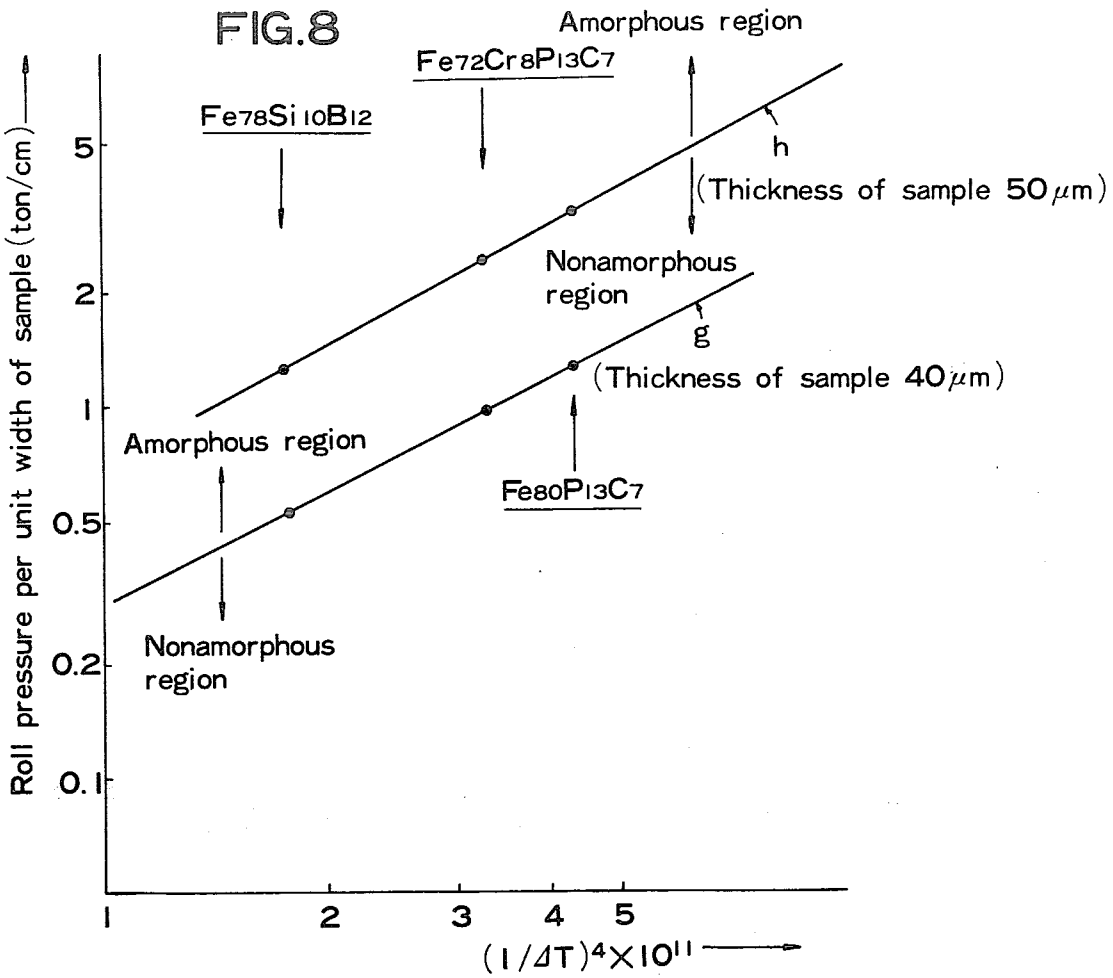
FIG. 8 is a set of graphs plotting roll pressure on the logarithmic scale against crystallization temperature for various film thicknesses.

Rolls made of iron whose diameter and rotational speed were 15 cm and 2850 r.p.m., respectively, were used for producing the above described amorphous alloys. The results showing the relationship between the crystallization temperature of the amorphous alloy and the roll pressure are shown in FIG. 8. In this graph, the abscissae represent $(1/\Delta T)^4 \times 10^{11}$, where $\Delta T = T_{cry} - 20°$ C., in which the roll temperature was 20° C. The results for three different amorphous alloys are shown in FIG. 8. When the thickness of the film was 40 microns, the line g represented the minimum roll pressure for obtaining amorphous alloys. When the thickness of the film was 50 microns, the line h represented the minimum roll pressure.

From FIG. 8 it will be understood that the roll pressures are inversely proportional to the crystallization temperature and that the following requirements should be fulfilled for obtaining an amorphous alloy:

$$Y \geqq k_2 \left(\frac{1}{T_{cry} - 20}\right)^4$$

where $k_2$ is a constant.

RELATIONSHIP BETWEEN MATERIAL OF THE ROLLS AND ROLL PRESSURE

From the results of FIGS. 2 to 8, we can state the general equation for obtaining an amorphous alloy:

$$Y \geqq C_o \left(\frac{X}{T_{cry} - 20}\right)^4 \quad (1)$$

where Y represents the roll pressure, X is the thickness of the film in microns, $T_{cry}$ is the crystallization temperature of amorphous alloy, and $C_o$ is a constant.

The value of $C_o$ is determined by the nature of the material of the rolls, and particularly Young's modulus and the heat conductivity of the material. Examples of the constant $C_o$ for different materials are given in Table 2.

Table 2

| Material of rolls | Constant $C_o$ |
|---|---|
| Fe (main component) | $1.27 \times 10^4$ |
| Cu | $1.0 \times 10^2$ |
| Cu - 35% Zn | $9.0 \times 10^2$ |
| Cu - 10% Zn | $6.0 \times 10^2$ |
| Al | $1.3 \times 10^2$ |
| Al - 12% Si (casting) | $2.6 \times 10^2$ |
| Al - 10% Mg (casting) | $7.2 \times 10^2$ |
| Al - 4.5% Cu (aging) | $1.9 \times 10^2$ |

From Table 2 it will be understood that the roll pressure required where the rolls are made of copper or aluminum is lower than for rolls of iron. Rolls made from copper or aluminum are also more advantageous from the viewpoint of quenching. It is possible, of course, to make the two rolls of different materials, for example, iron and copper, or iron and aluminum.

The relationship between the constant $C_o$, Young's modulus E and the heat conductivity K are shown in Table 3.

Table 3

| Material of roll | Young's modulus E ($10^3$kg/mm$^2$) | heat conductivity K (Watt cm$^{-1}$ deg$^{-1}$) | $E/K^2$ | $Co/(E/K^2)$ |
|---|---|---|---|---|
| Fe(Main Component) | 20 | 0.45 ~ 0.52 | 9.9 ~ 7.4 × $10^4$ | 0.13 ~ 0.17 |
| Cu | 11 | 3.9 | 7.2 × $10^2$ | 0.14 |
| Cu - 35% Zn | 10 | 1.2 | 6.9 × $10^3$ | 0.13 |
| Cu - 10% Zn | 12 | 1.9 | 3.3 × $10^3$ | 0.18 |
| Al | 6.9 | 2.2 | 1.4 × $10^3$ | 0.09 |
| Al - 12% Si | 7.1 | 1.6 ~ 2.1 | 2.8 ~ 1.6 × $10^3$ | 0.09 ~ 0.16 |
| Al - 4.5% Cu | 7.1 | 1.9 | 2.0 × $10^3$ | 0.10 |

From Table 3 it will be noted that the constant $C_o$ is approximately proportional to $E/K^2$. Accordingly, the relationship can be expressed as follows:

$$C_o = a(E/K^2).$$

From the standpoint of quenching efficiency of the rolls, the constant a should be larger than 0.09 and preferably larger than 0.15. In the optimum case, it is larger than 0.18.

RELATIONSHIP BETWEEN ROTATIONAL SPEED OF ROLLS AND ROLL PRESSURE

Figure 9:
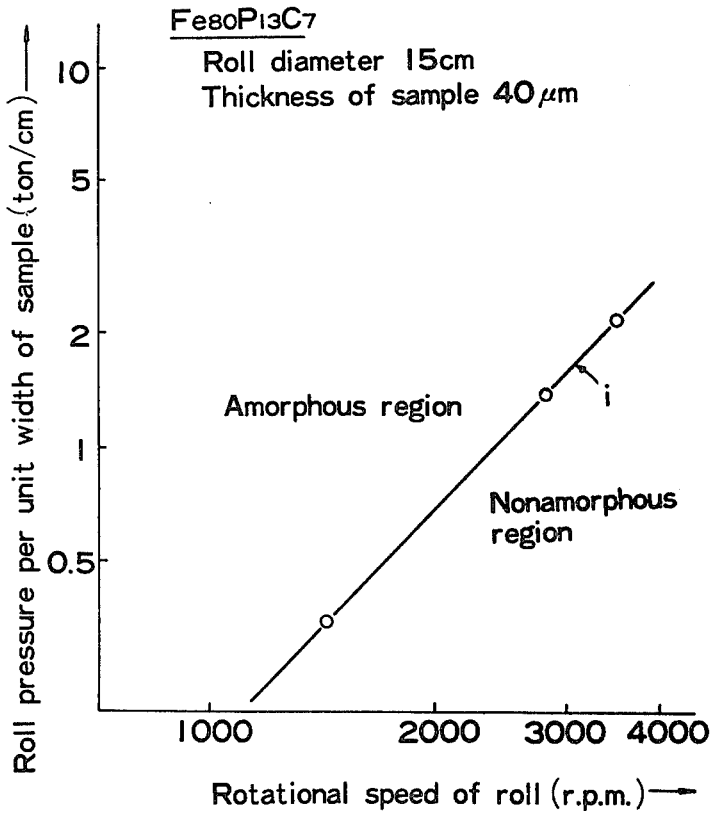
FIGS. 9 to 11 are graphs showing the relationship between roll pressure and the rotational speed of the rolls for various materials.

Tests were made to determine the relationship between the rotational speed of the rolls and the roll pressure to obtain an amorphous alloy film of $Fe_{80}P_{13}C_7$ having a thickness of 40 microns, using rolls made of iron and having a diameter of 15 cm. The results are shown in FIG. 9. From this Figure, it will be seen that the region above the line i should be selected to obtain an amorphous alloy with respect to the roll pressure.

Figure 10:
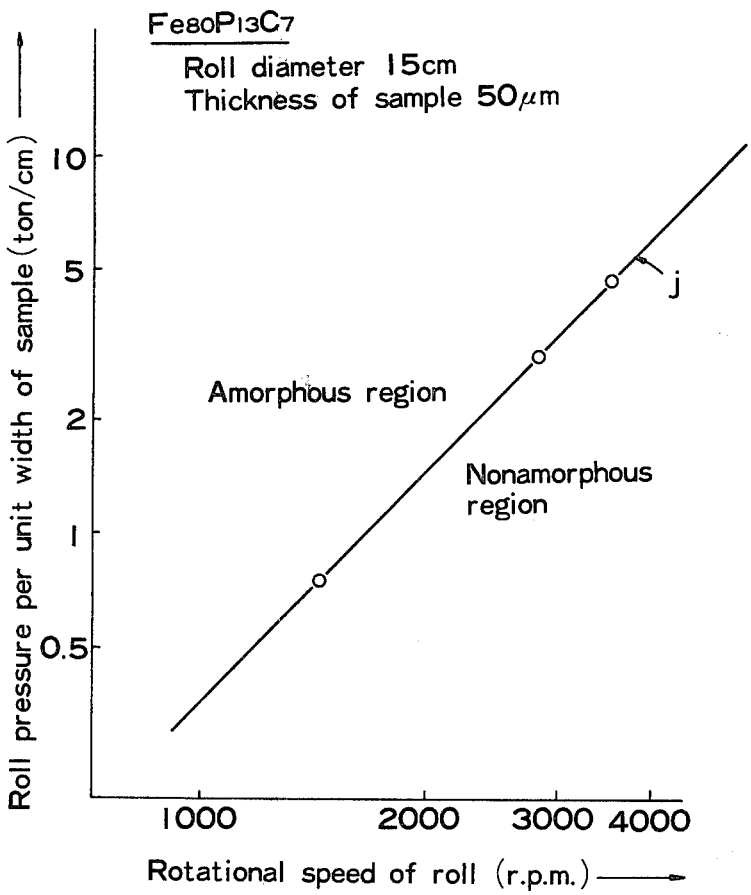

FIG. 10 shows the results of tests on the relationship between roll pressure and rotational speed of the rolls for obtaining an amorphous alloy film having a thickness of 50 microns. The other test conditions and the material of the amorphous alloy were the same as in FIG. 9. It will be noted from the graph of FIG. 10 that a region above the line j should be selected for obtaining an amorphous alloy.

Figure 11:
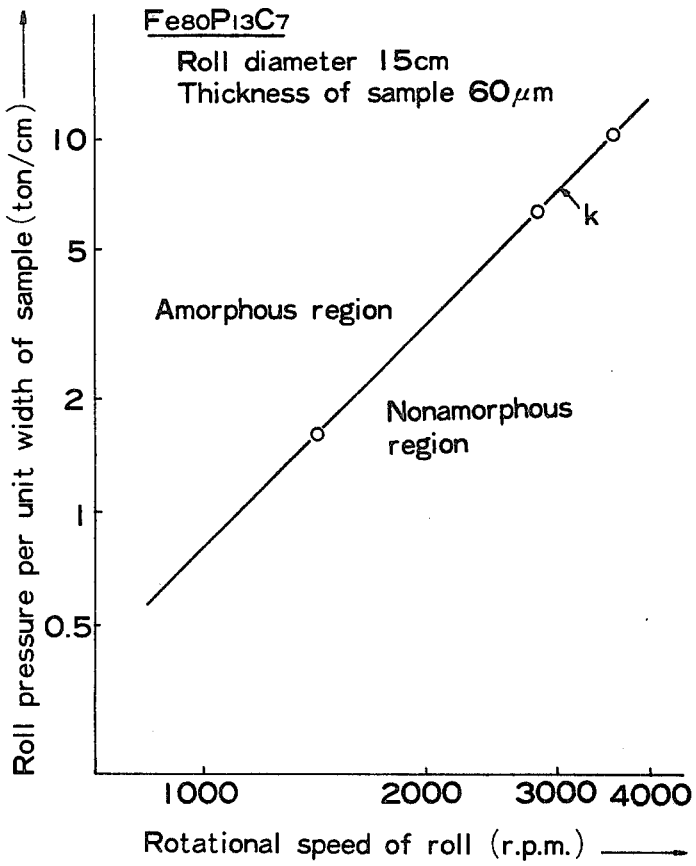

FIG. 11 shows the results of tests on the relationship between roll pressure and rotational speed to obtain an amorphous alloy film having a thickness of 60 microns. The other test conditions were the same as in FIG. 9. Here, it will be noted that an amorphous alloy will be formed above the line k.

It will be noted from the results of FIGS. 9 to 11 that the roll pressures on the lines i to k are substantially proportional to the square of the rotational speed of the rolls. The above described constant $C_o$ is the value obtained for a rotational speed of 2850 r.p.m. Therefore, in the general case the relationship (1) will be:

$$C_1 = C_o\left(\frac{A}{2850}\right)^2 \quad (2)$$

where A represents the rotational speed of the rolls.

RELATIONSHIP BETWEEN DIAMETER OF ROLLS AND ROLL PRESSURE

Figure 12:
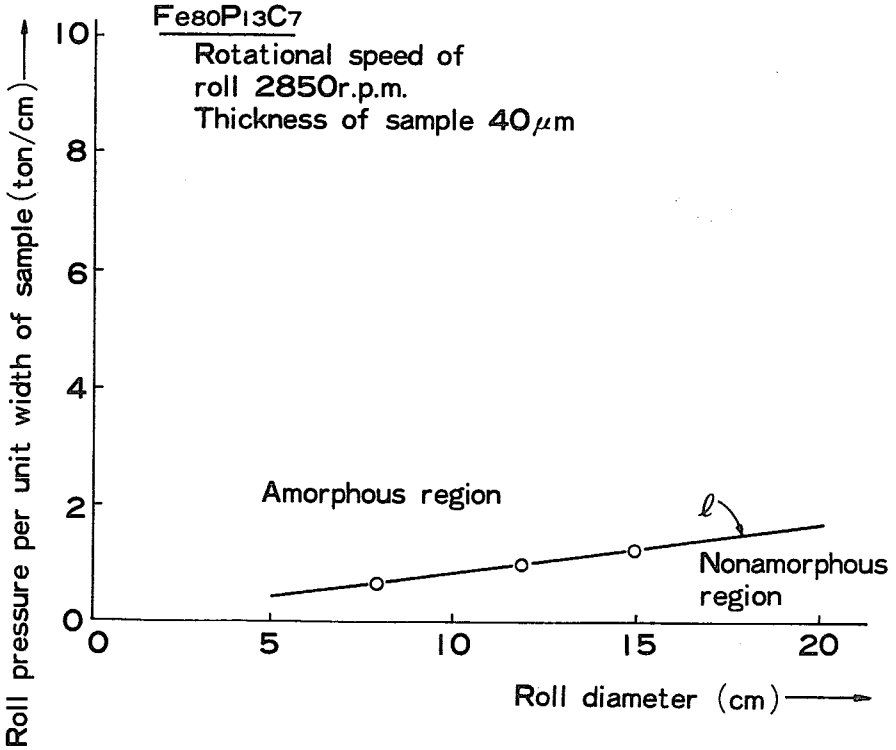
FIGS. 12 to 14 are graphs showing the relationships between roll pressure on a linear scale to roll diameter for various amorphous alloys.

Tests were made on the relationship between the diameter of the rolls and the roll pressure to obtain an amorphous alloy film of $Fe_{80}P_{13}C_7$ having a thickness of 40 microns, using rolls made of iron and rotated at a speed of 2850 r.p.m. The results are shown in FIG. 12. From this graph, it will be seen that the area above the line L should be selected to obtain an amorphous alloy with respect to the roll pressure.

Figure 13:
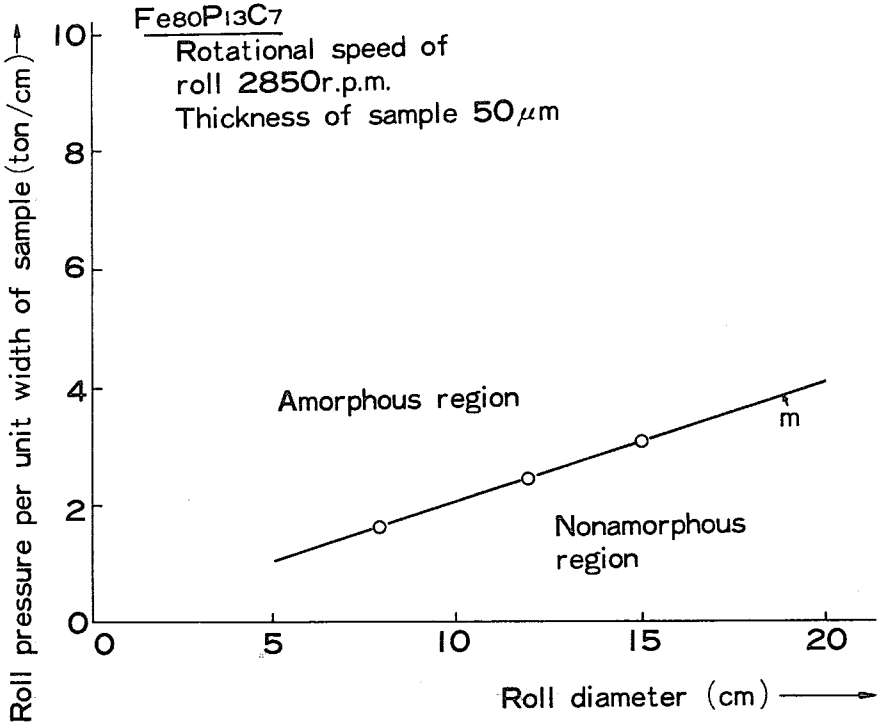

FIG. 13 shows the results of tests setting forth the relationship between roll pressure and the diameter of the rolls to obtain an amorphous alloy film having a thickness of 50 microns. The other test conditions were the same as those in FIG. 12. In FIG. 13, the region for obtaining an amorphous alloy extends above the line m.

Figure 14:
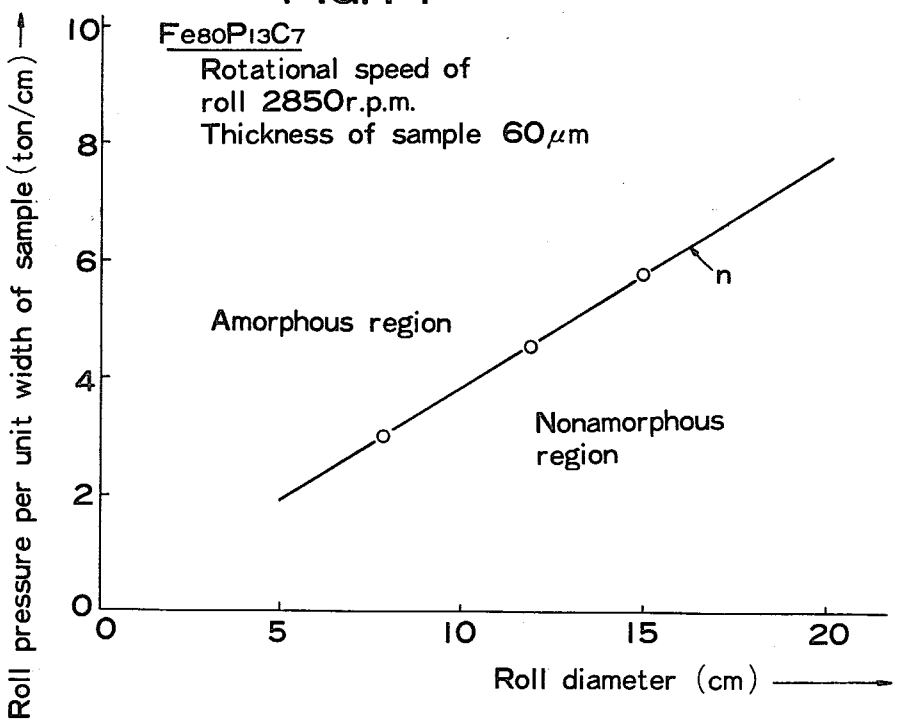

In FIG. 14 there is shown results of tests on the relationship between roll pressure and the diameter of rolls to obtain an amorphous alloy film having a thickness of 60 microns. The same test conditions and the material of the amorphous alloy were the same as in the case of FIG. 12. In FIG. 14, the area above the line N should be selected to obtain an amorphous alloy with respect to the roll pressure.

From FIGS. 12 to 14 it will be noted that the roll pressures on the lines l to n are substantially proportional to the diameters of the rolls. The above described constant $C_o$ was derived for a rotational speed of 2850 r.p.m. and a roll diameter of 15 cm. Accordingly, in the general case, the constant C will be:

$$C = C_l(R/15) \quad (3)$$

where R is the diameter of the rolls.

In the general case, therefore, the roll pressure equation becomes:

$$Y \geqq C\left(\frac{X}{T_{cry} - T}\right)^4$$

where T represents the temperature of the rolls in °C., $C = C_l(R/15)$ and $$C_1 = C_o\left(\frac{A}{2850}\right)^2.$$

Although the temperature of the rolls was 20° C. in equation (1), the same results as those of FIG. 8 were obtained with other roll temperatures.

Although the diameters of the rolls 1 and 2 were equal to each other in the above-described embodiment, they may be different. In such a case, the diameter R of the rolls is represented by the following equation:

$$\frac{1}{R} = \frac{1}{2}\left(\frac{1}{R_1} + \frac{1}{R_2}\right)$$

where $R_1$ and $R_2$ represent the respective diameters of the rolls.

Although various embodiments of the invention have been described in detail herein with reference to the accompanying drawings, it is to be understood that the invention is not limited to these precise embodiments, and that various changes and modifications can be effected therein by one skilled in the art without departing from the scope and spirit of the invention as defined in the appended claims.

We claim as our invention:

1. A method of manufacturing an amorphous alloy comprising the steps of:

preparing a molten mixture of the raw materials going into said alloy, rolling and quenching said molten mixture between a pair of oppositely rotating rolls to form a film of amorphous alloy, said rolling and quenching being carried out under the following conditions:

$$Y \geqq C_o\left(\frac{A}{2850}\right)^2\left(\frac{R}{15}\right)\left(\frac{X}{T_{cry}-T}\right)^4$$

where:

Y is the roll pressure per unit width of film, in metric tons per centimeter, $C_o$ is a constant determined by Young's modulus and the thermal conductivity of the material of said rolls, A is the rotational speed of said rolls in r.p.m., R is the diameter of the rolls in centimeters, X is the thickness of said film in microns, $T_{cry}$ is the crystallization temperature of said amorphous alloy in °C., T is the temperature of said rolls in °C., and $$\frac{1}{R} = \frac{1}{2}\left(\frac{1}{R_1} + \frac{1}{R_2}\right)$$

where the rolls have diameters of $R_1$ and $R_2$ cm respectively.

2. A method according to claim 1 in which said film is guided from said rolls onto a heat conductive rotary drum adjacent to said rolls to further cool said film.

3. A method according to claim 2 in which said rolls are made of hard steel.

4. A method according to claim 2 in which said rotary drum is made of copper.

5. A method according to claim 2 in which said rolls rotate at different peripheral speeds.

6. A method according to claim 2 which includes the step of guiding said film from said rotary drum into a liquid bath of coolant.

7. A method according to claim 1 in which $C_o$ is determined as follows:

$$C_o = a\frac{E}{K^2}$$

where:

a is a constant larger than 0.09,

E is Young's modulus for the material of said rolls, and

K is the thermal conductivity of the material of said rolls.

8. A method according to claim 7 in which a is a constant larger than 0.15.

9. A method according to claim 7 in which a is a constant larger than 0.18.

10. A method according to claim 2 in which said rotary drum is rotated at a higher speed than said rolls.

11. A method according to claim 1 in which said rolls are of equal diameter.

* * * * *